US012054916B2

(12) United States Patent
Horii

(10) Patent No.: US 12,054,916 B2
(45) Date of Patent: Aug. 6, 2024

(54) WORKING MACHINE

(71) Applicant: KUBOTA CORPORATION, Osaka (JP)

(72) Inventor: Hiroshi Horii, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 460 days.

(21) Appl. No.: 17/535,802

(22) Filed: Nov. 26, 2021

(65) Prior Publication Data

US 2022/0081876 A1 Mar. 17, 2022

Related U.S. Application Data

(63) Continuation of application No. PCT/JP2020/023710, filed on Jun. 17, 2020.

(30) Foreign Application Priority Data

Jun. 19, 2019 (JP) ..... 2019-113795

(51) Int. Cl.
*E02F 9/22* (2006.01)
*E02F 3/32* (2006.01)
(Continued)

(52) U.S. Cl.
CPC ..... *E02F 9/2203* (2013.01); *E02F 3/435* (2013.01); *E02F 9/2033* (2013.01); *E02F 9/24* (2013.01);
(Continued)

(58) Field of Classification Search
None
See application file for complete search history.

(56) References Cited

U.S. PATENT DOCUMENTS 10,106,952 B2 * 10/2018 Iwamura ..... E02F 3/435
2001/0046433 A1 11/2001 Nishimura et al.
(Continued)

FOREIGN PATENT DOCUMENTS

EP 3 493 010 A1 6/2019
JP 11-247217 A 9/1999
(Continued)

OTHER PUBLICATIONS

Chinese Office Action and Search Report for Chinese Application No. 202080039760.7, dated Jul. 8, 2022, with English translation.
(Continued)

*Primary Examiner* — James J Lee
*Assistant Examiner* — Jonathan E Reinert
(74) *Attorney, Agent, or Firm* — BIRCH, STEWART, KOLASCH & BIRCH, LLP

(57) ABSTRACT

In a working machine, a stroke of an arm cylinder caused when a distance of a tip portion of an arm from a machine body is equal to a predetermined limit distance is defined as a stroke Y1, a stroke of a boom cylinder caused when the stroke of the arm cylinder is equal to the stroke Y1 and a height of the tip portion of the arm is equal to a height of a boom pivot shaft is defined as a stroke X1, and when the stroke of the boom cylinder is between X1 and a stroke end thereof in a direction to swing the boom upward, the controller restricts the stroke of the arm cylinder to swing the arm in a dumping direction to prevent the arm from swinging further in the dumping direction from a position where the stroke of the arm cylinder is equal to Y1.

9 Claims, 6 Drawing Sheets

(51) Int. Cl.

| | |
|---|---|
| ***E02F 3/43*** | (2006.01) |
| ***E02F 9/20*** | (2006.01) |
| ***E02F 9/24*** | (2006.01) |
| ***E02F 9/26*** | (2006.01) |

(52) U.S. Cl.
CPC ..... *E02F 9/265* (2013.01); *E02F 3/325* (2013.01); *E02F 9/2228* (2013.01); *E02F 9/2267* (2013.01); *E02F 9/2271* (2013.01)

(56) References Cited

U.S. PATENT DOCUMENTS

| | | | | |
|---|---|---|---|---|
| 2016/0281331 | A1* | 9/2016 | Ikegami ..... | E02F 9/2285 |
| 2019/0127953 | A1 | 5/2019 | Wetzel et al. | |
| 2020/0399868 | A1* | 12/2020 | Okazaki ..... | E02F 3/32 |

FOREIGN PATENT DOCUMENTS

| | | | |
|---|---|---|---|
| JP | 2001-336172 | A | 12/2001 |
| JP | 2009-121095 | A | 6/2009 |
| JP | 2018-69867 | A | 5/2018 |

OTHER PUBLICATIONS

Extended European Search Report for European Application No. 20827920.8, dated May 25, 2023.
International Search Report for PCT/JP2020/023710 mailed on Sep. 8, 2020.
Written Opinion of the International Searching Authority for PCT/JP2020/023710 mailed on Sep. 8, 2020.

* cited by examiner

WORKING MACHINE

CROSS REFERENCE TO RELATED APPLICATIONS

This application is a continuation application of International Application No. PCT/JP2020/023710, filed on Jun. 17, 2020, which claims the benefit of priority to Japanese Patent Application No. 2019-113795, filed on Jun. 19, 2019. The entire contents of each of these applications are hereby incorporated herein by reference.

BACKGROUND OF THE INVENTION

1. Field of the Invention

The present invention relates to a working machine such as a backhoe.

2. Description of the Related Art

A working machine disclosed in Japanese Unexamined Patent Publication No. 2018-69867 is already known.

The working machine disclosed in Japanese Unexamined Patent Publication No. 2018-69867 includes a front working device installed at a front portion of a machine body. The front working device includes a boom pivotably supported by the machine body swingably upward and downward and an arm pivotally supported by the boom. The arm is swingable in a dumping direction separating away from the boom and in a crowding direction approaching the boom. The boom is swung by a boom cylinder, and the arm is swung by the arm cylinder.

SUMMARY OF THE INVENTION

In the working machine including the boom and the arm, when setting a large depth as an excavation depth defined when the boom and the arm are stretched in the excavation direction, a reach from the machine body to a tip portion of the arm becomes large when the boom and arm are stretched in a horizontal direction; accordingly, this configuration causes a problem that stability of the machine body deteriorates.

In some cases, a long arm (L/A) specification is adopted to set a large excavation depth; however, the L/A specification is recommended to be combined with a narrow bucket for stability. In addition, a height of the bucket bottom becomes quite low, so it is necessary to raise a bucket height through an arm dumping operation in an operation to move earth and sand upward, such as dump loading, which makes it difficult to efficiently perform work.

In view of the above-described problems, the present invention intends to ensure stability in a case a boom and arm are stretched in the horizontal direction with a bucket height and an excavation depth each set to be large.

A working machine according to an aspect of the invention, includes a machine body, a boom pivotally supported by the machine body via a boom pivot shaft so as to be swingable upward and downward, an arm pivotally supported by the boom so as to be swingable in a dumping direction away from the boom and a crowding direction toward the boom, a boom cylinder to swing the boom, an arm cylinder to swing the arm, and a controller configured or programmed to control the arm cylinder. A stroke of the arm cylinder caused when a distance of a tip of the arm from the machine body is equal to a predetermined limit distance is defined as a stroke Y1, a stroke of the boom cylinder caused when the stroke of the arm cylinder is equal to the stroke Y1 and a height of the tip of the arm is equal to a height of the boom pivot shaft is defined as a stroke X1, and when the stroke of the boom cylinder is between the stroke X1 and a stroke end thereof in a direction to swing the boom upward, the controller is configured or programmed to restrict the stroke of the arm cylinder to swing the arm in the dumping direction so as to prevent the arm from swinging further in the dumping direction from a position where the stroke of the arm cylinder is equal to the stroke Y1.

Also, the tip of the arm, when the distance thereof from the machine body is equal to the limit distance, is located between a first locus of the tip of the arm in swinging centered on the boom pivot shaft and a second locus of a tip of the boom in swinging centered on the boom pivot shaft.

Also, when the tip of the arm is located at an intersection between the first locus and a vertical line extended downward from the tip of the arm and when the stroke of the arm cylinder is equal to the stroke Y1 and the stroke of the boom cylinder is equal to the stroke X1, the stroke of the boom cylinder is defined as a stroke X2, and when the boom is swung within a swing range defined by the boom cylinder activating with variation of the stroke in a stroke range between the stroke X1 and the stroke X2, the controller restricts the stroke of the arm cylinder to swing the arm in the dumping direction relative to the boom at any position in the swing range so as to prevent the tip of the arm from moving across the vertical line.

Also, when the boom cylinder is activated with variation of the stroke in the stroke range between the stroke X1 and the stroke X2 and the stroke of the arm cylinder is less than the stroke Y1, the controller is configured or programmed to automatically control the arm cylinder so as to swing the arm in the crowding direction to move the tip of the arm on the vertical line.

Also, when the boom is swung from the position where the stroke of the boom cylinder is equal to the stroke X2, the controller does not restrict the stroke of the arm cylinder.

Also, the controller includes a warning unit configured or programmed to give a warning when the stroke of the boom cylinder is in a stroke range such as to locate the boom above the position of the boom defined by the stroke X2 of the boom cylinder and the stroke of the arm cylinder is in a stroke range such as to locate the arm in the dumping direction from the position defined by the stroke Y1 of the arm cylinder.

Also, the controller includes a cancellation unit configured or programmed to cancel restriction of a stroke of the arm cylinder in the dumping direction.

Also, the working machine further includes a swing bracket provided on the front portion of the machine body rotatably around a vertical axis, a boom angle sensor configured to detect a swing angle of the boom relative to the machine body, and an arm angle sensor configured to detect a swing angle of the arm relative to the boom. The boom is pivotally supported by the swing bracket via the boom pivot shaft, and the controller includes a calculation unit configured or programmed to calculate a position of the tip of the arm based on detection values detected by the boom angle sensor and the arm angle sensor.

Also, the controller includes a cancellation unit configured or programmed to cancel the warning given by the warning unit.

The above and other elements, features, steps, characteristics and advantages of the present invention will become more apparent from the following detailed description of the preferred embodiments with reference to the attached drawings.

BRIEF DESCRIPTION OF THE DRAWINGS

A more complete appreciation of preferred embodiments of the present invention and many of the attendant advantages thereof will be readily obtained as the same becomes better understood by reference to the following detailed description when considered in connection with the accompanying drawings described below.

DETAILED DESCRIPTION OF THE PREFERRED EMBODIMENTS

Figure 1:
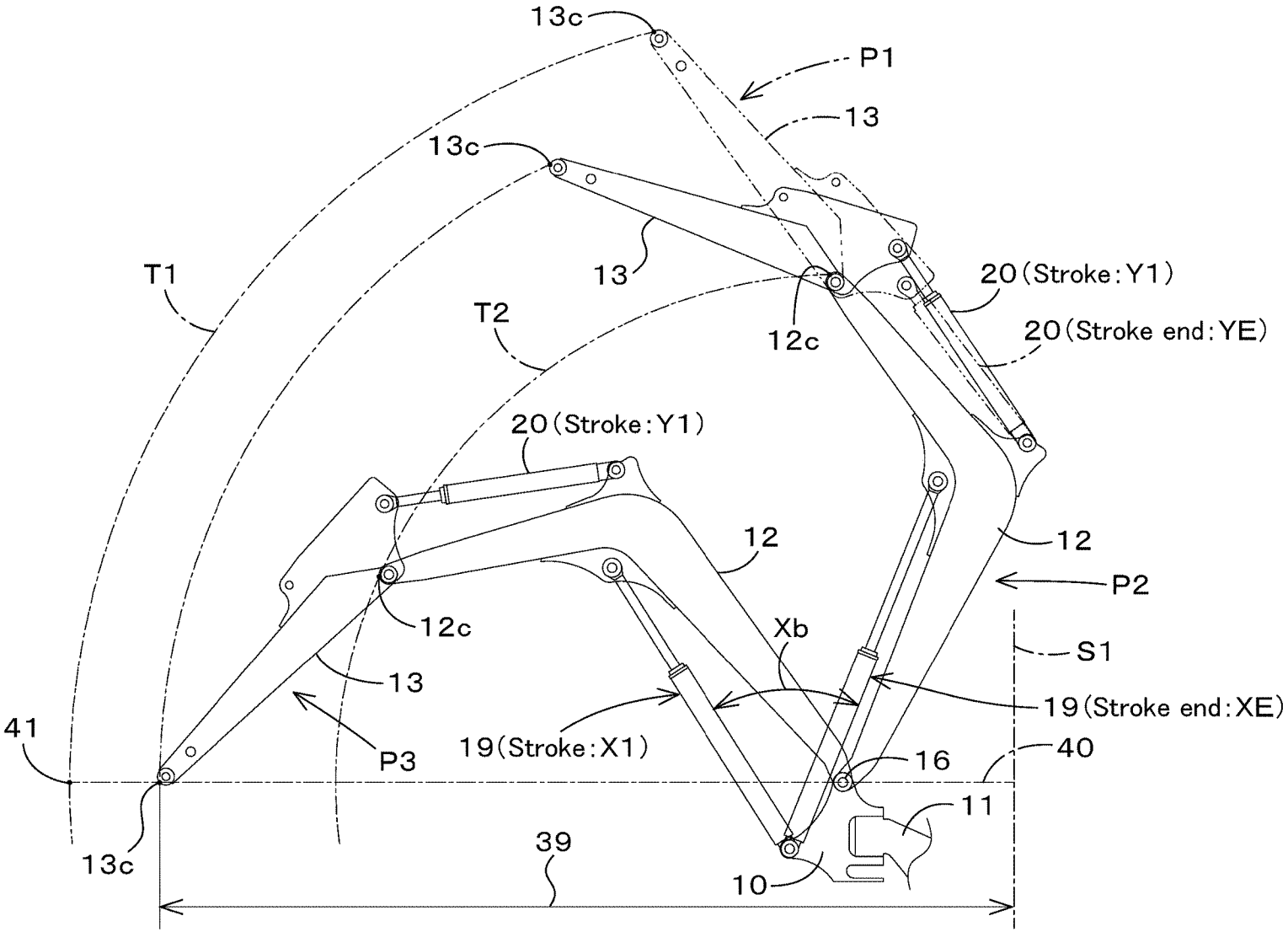
FIG. 1 is a side view showing movements of a boom and an arm.

The preferred embodiments will now be described with reference to the accompanying drawings, wherein like reference numerals designate corresponding or identical elements throughout the various drawings. The drawings are to be viewed in an orientation in which the reference numerals are viewed correctly.

Referring to the drawings as appropriate, an embodiment of the present invention will be described below.

Figure 6:
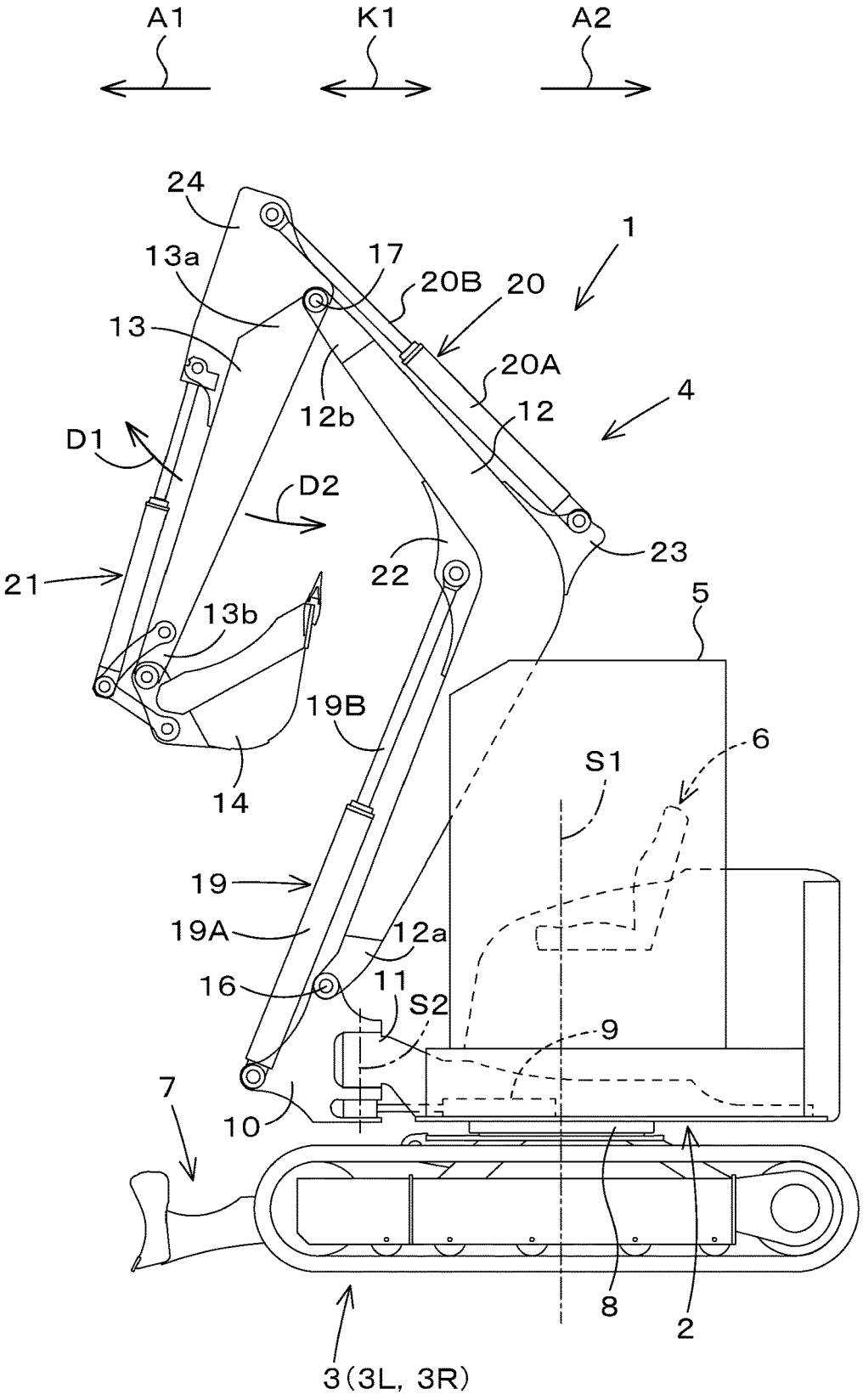
FIG. 6 is a side view of a working machine.

FIG. 6 is a schematic side view showing an overall configuration of a working machine 1 according to the embodiment. In the embodiment, a backhoe, that is a swiveling working machine, is exemplified as the working machine 1.

As shown in FIG. 6, the working machine 1 includes a machine body (swiveling platform) 2, traveling devices 3, and a front working device 4. On the machine body 2, an operator's seat (seat) 6 on which an operator (driver) is seated is mounted. The operator's seat is disposed inside a cabin 5.

In explanation of this embodiment, a forward direction from the operator seated in the operator's seat 6 of the working machine 1 (a direction of an arrowed line A1 in FIG. 6) is referred to as the front, a backward direction from the operator (a direction of an arrowed line A2 in FIG. 6) is referred to as the rear, a leftward direction from the operator (a direction of a front surface side in FIG. 6) is referred to as the left, and a rightward direction from the operator (a direction of a back surface side in FIG. 6) is referred to as the right. In addition, a horizontal direction, which is a direction orthogonal to a fore-and-aft direction (longitudinal direction in machine body) K1 shown in FIG. 6, is described as a machine width direction (a width direction in the machine body 2). In addition, a direction from a center portion of the machine body 2 to the right or left in the width direction is described as a distal direction in the machine body. A direction opposite to the distal direction in the machine body is described as a proximal direction in the machine body.

As shown in FIG. 6, the traveling devices 3 are crawler-type traveling devices including a first crawler traveling body 3L disposed on one side (left portion) of the machine body 2 in the width direction and a second crawler traveling body 3R disposed on the other side (right portion) of the machine body 2 in the width direction. The traveling devices 3 support the machine body 2 such that the machine body 2 can travel. A dozer device 7 is attached to front portions of the traveling devices 3. In addition, the machine body 2 is supported on the traveling devices 3 such that the machine body 2 can be swiveled, via a swiveling bearing 8, leftward and rightward around a swiveling axis S1 that extends in the vertical direction.

As shown in FIG. 6, the front working device 4 is disposed forward of the machine body 2. In addition, the front working device 4 is supported by a swing bracket 10 disposed on a front portion of the machine body 2. The swing bracket 10 is supported, rotatably around the vertical axis (an axis extending in the vertical direction) S1, by a support bracket 11 protruding forward from the machine body 2. The swing bracket 10 is swung leftward and rightward by a swing cylinder 9 attached to the machine body 2. The front working device 4 includes a boom 12, an arm 13, and a working tool (bucket) 14.

The boom 12 is pivotally supported at a base end 12*a* thereof on an upper portion of the swing bracket 10 via a boom pivot shaft 16. In detail, the boom pivot shaft 16 includes a shaft center (lateral axis) extending in the horizontal direction, and the boom 12 is pivotally supported swingably up and down around the horizontal axis. The arm 13 includes a base end 13*a* pivotally supported on a tip end 12*b* of the boom 12 via an arm pivot shaft 17. In detail, the arm pivot shaft 17 has an shaft center parallel to the boom pivot shaft 16, and the arm 13 is supported swingably in the dumping direction D1 or the crowding direction D2 around the horizontal axis. The dumping direction D1 is a direction in which the arm 13 separates away from the boom 12, and the crowding direction D2 is a direction in which the arm 13 approaches the boom 12. The working tool 14 is pivotably supported by the tip end 13*b* of the arm 13.

As shown in FIG. 6, the front working device 4 includes a boom cylinder 19 that drives the boom 12, an arm cylinder 20 that drives the arm 13, and a working tool cylinder 21 that drives the working tool 14. Each of the swing cylinder 9, boom cylinder 19, arm cylinder 20, and working tool cylinder 21 is constituted of a double-acting hydraulic cylinder. The hydraulic cylinder includes a cylinder tube and a piston rod that can protrude and retract from and into the cylinder tube, and is configured to be extended and contracted. The hydraulic cylinder is extended when the piston rod protrudes from the cylinder tube, and is contracted when the piston rod is retracted relative to the cylinder tube.

As shown in FIG. 6, in the embodiment, the boom cylinder 19 is disposed forward of a lower portion of the boom 12. In the boom cylinder 19, a bottom portion of the cylinder tube 19A is pivotably supported, rotatably around the lateral direction, by a front portion of the swing bracket 10. The piston rod 19B of the boom cylinder 19 is pivotally supported, rotatably around the lateral axis, by a first stay 22 fixed to an intermediate portion of the boom 12 in the longitudinal direction. Accordingly, when the boom cylinder 19 is extended (actuated in a raising direction to swing the boom 12 upward), the boom 12 swings upward, and when the boom cylinder 19 is contracted (actuated in a lowering direction to swing the boom 12 downward), the boom 12 swings downward.

In this embodiment, the arm cylinder 20 is disposed upward of an upper portion of the boom 12. In the arm cylinder 20, a bottom portion of the cylinder tube 20A is pivotably supported, rotatably around the lateral direction, by a second stay 23 fixed to an intermediate portion of the boom 12 in the longitudinal direction. A piston rod 20B of the arm cylinder 20 is pivotably supported, rotatably around the lateral axis, by a bracket member fixed to an upper portion of the arm 13. Accordingly, when the arm cylinder 20 is extended, the arm 13 swings in the crowding direction, and when the arm cylinder 20 is contracted, the arm 13 swings in the dumping direction.

Figure 3:
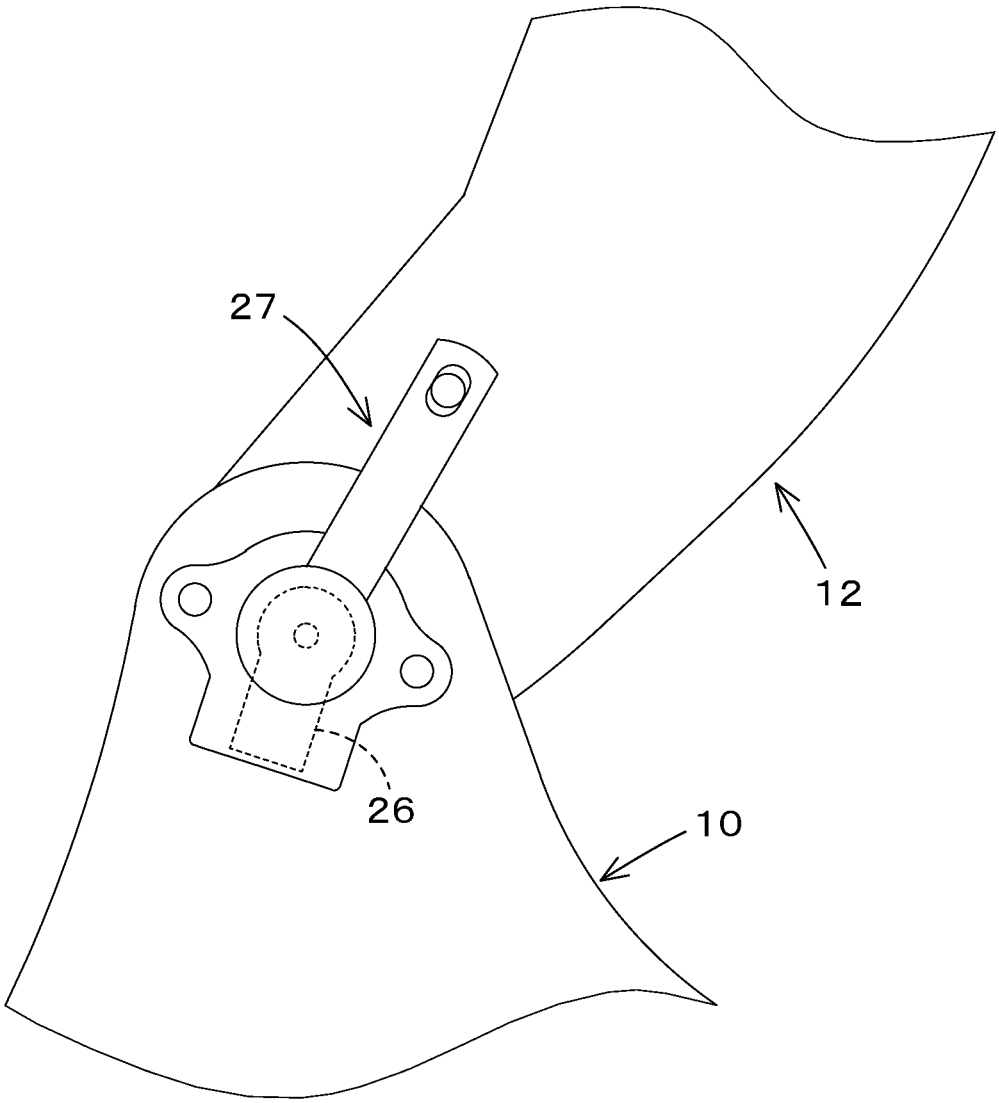
FIG. 3 is a side view of an attaching portion of a boom angle sensor.

As shown in FIG. 3, a boom angle sensor 26 is attached to the swing bracket 10 to detect a swing angle of the boom 12 relative to the machine body 2. The boom angle sensor 26 is constituted of a potentiometer, for example. The boom angle sensor 26 is interlockingly connected to the boom 12 by a first interlocking linkage 27. The boom angle sensor 26 detects a rotation angle of the boom 12 around the boom pivot shaft 16, thereby detecting a swing angle of the boom 12 relative to the machine body 2.

Figure 4:
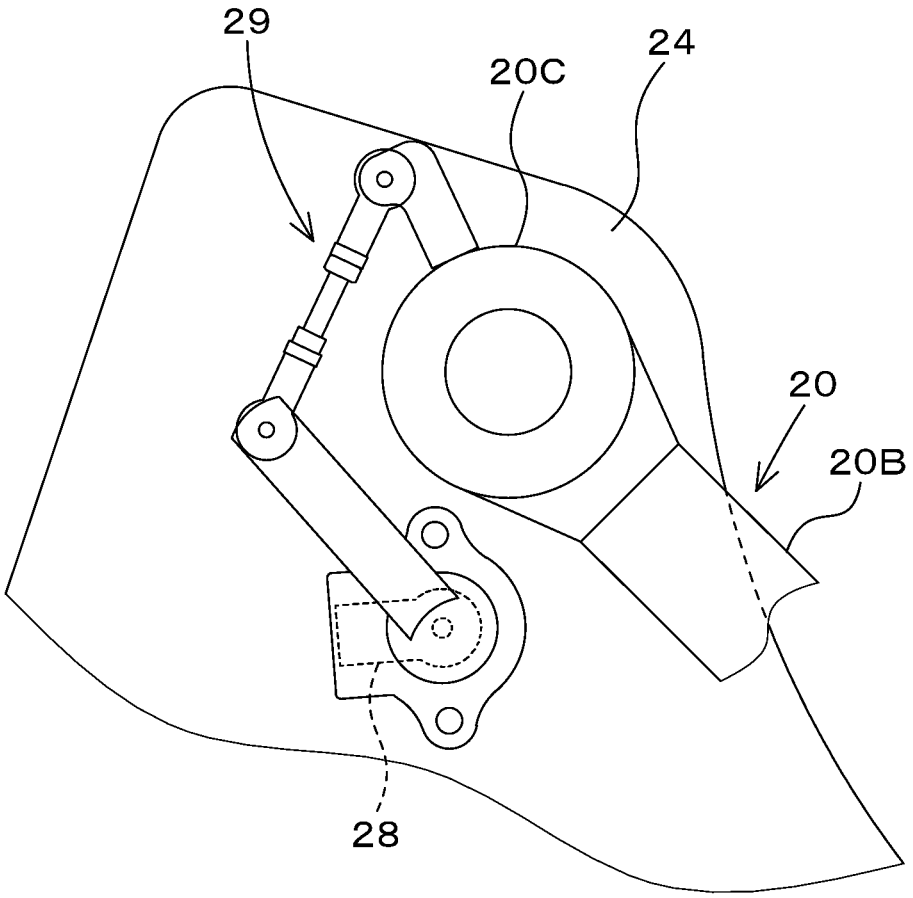
FIG. 4 is a side view of an attaching portion of an arm angle sensor.

As shown in FIG. 4, an arm angle sensor 28 is attached to the bracket member 24 to detect a swing angle of the arm 13 relative to the boom 12. The arm angle sensor 28 is constituted of a potentiometer, for example. The arm angle sensor 28 is interlockingly connected to the piston rod 20B of the arm cylinder 20 by a second interlocking linkage 29. In detail, the second interlocking link 29 is connected to a boss portion 20C of the piston rod 20B that is connected to the arm pivot shaft 17. Accordingly, the arm angle sensor 28 detects a rotation angle of the arm 13 around the arm pivot shaft 17 by detecting a stroke of the arm cylinder 20, thereby detecting a swing angle of the arm 13 relative to the boom 12. The arm angle sensor 28 may directly detect the rotation angle of the arm 13 around the arm pivot shaft 17.

Figure 5:
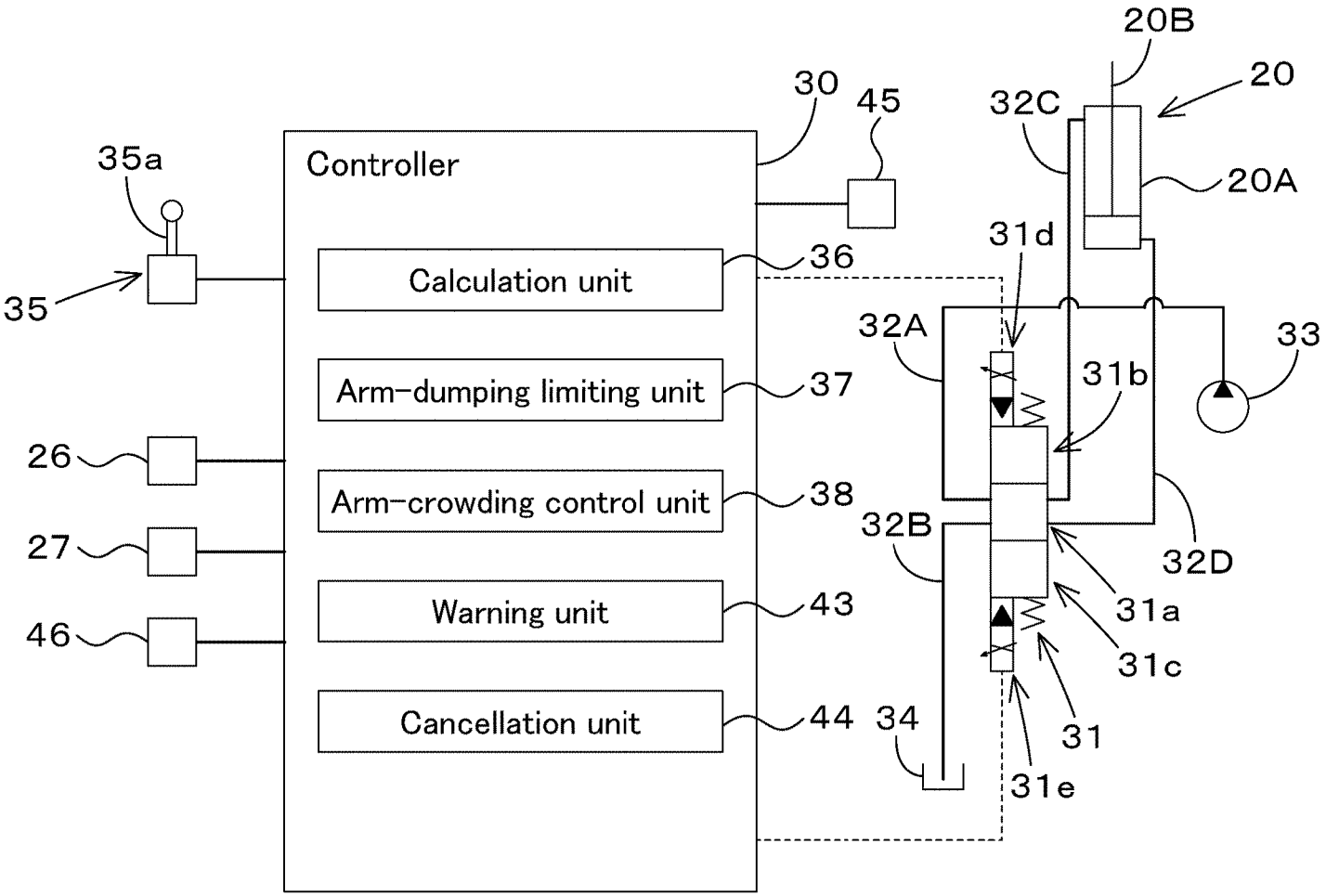
FIG. 5 is a schematic view of a control system.

As shown in FIG. 5, the working machine 1 includes a controller 30 that controls the swinging of the arm 13 and an arm control valve 31 that controls the arm cylinder 20.

The controller 30 is constituted using a microcomputer including, for example, a CPU (Central Processing Unit) and an EEPROM (Electrically Erasable Programmable Read-Only Memory).

The arm control valve 31 is a control valve electrically controlled by the controller 30, for example, a pilot-acting solenoid proportional directional control valve a is adopted. This pilot-acting solenoid proportional directional control valve is a valve that moves a main spool with a pilot pressure controlled by a solenoid to control a flow of hydraulic fluid. In addition, the arm control valve 31 is constituted of a three-position switching valve shiftable to a neutral position 31*a*, a first position 31*b*, or a second position 31*c*. The arm control valve 31 includes a first solenoid 31*d* and a second solenoid 31*e*. The first solenoid 31*d* and the second solenoid 31*e* are connected to the controller 30 and are magnetized or demagnetized by a command signal output from the controller 30. By magnetizing or demagnetizing the first solenoid 31*d* and the second solenoid 31*e*, the arm control valve 31 can be shifted from the neutral position 31*a* to either the first position 31*b* or the second position 31*c*.

The arm control valve 31 is connected to a hydraulic pump 33 via a supply fluid passage 32A and to a tank 34 via a drain fluid passage 32B. In addition, the arm control valve 31 is connected to the cylinder tube 20A of the arm cylinder 20 via a first cylinder fluid passage 32C and the second cylinder fluid passage 32D. In detail, the first cylinder fluid passage 32C is connected to a head portion (a side from which the piston rod protrudes) of the cylinder tube 20A, and the second cylinder fluid passage 32D is connected to a bottom portion of the cylinder tube 20A.

As shown in FIG. 5, the controller 30 is connected to an operation member 35 that operates the arm 13. The controller 30 is capable of acquiring operation signals from the operation member 35. The operation member 35 is disposed in the vicinity of the operator's seat 6 and includes a lever 35*a* that can be grasped and operated by an operator. The lever 35*a* can be swung from the neutral position in one direction and in the other direction opposite to the one direction. For example, when the lever 35*a* is swung in the one direction, the first solenoid 31*d* is magnetized, and the arm control valve 31 is shifted to the first position 31*b*. When the arm control valve 31 is shifted to the first position 31*b*, the arm cylinder 20 is contracted and the arm 13 swings in the dumping direction D1. In addition, when the lever 35*a* is swung in the other direction, the second solenoid 31*e* is magnetized, and the arm control valve 31 is shifted to the second position 31*c*. When the arm control valve 31 is shifted to the second position 31*c*, the arm cylinder 20 is extended, and the arm 13 swings in the crowding direction D2. When the lever 35*a* is returned to the neutral position, the arm control valve 31 returns to the neutral position 31*a*, and the extending or contracting action of the arm cylinder 20 stop. That is, the movement of the arm 13 stops.

The arm control valve 31 may be a direct-acting solenoid directional switching valve constituted of a proportional valve. In addition, the arm control valve 31 may be constituted of a pilot operation valve to be operated by a pilot pressure, an ON-OFF valve (with shock-mitigating throttle) may be interposed in a pilot fluid passage connected to a pressure-receiving portion that shifts the arm control valve 31 to the first position 31*b*. In this configuration, the ON-OFF valve can be controlled to limit a stroke of the arm cylinder 20 in the dumping direction. In addition, an electric cushion may be adopted to perform a cushion control to decelerate the piston rod 20B by adjusting a supply amount of hydraulic fluid when the arm cylinder 20 approaches a stroke end.

The controller 30 is connected to the boom angle sensor 26 and the arm angle sensor 28. The controller 30 can acquire detection values of the boom angle sensor 26 and the arm angle sensor 28. The controller 30 includes a calculation unit 36. The calculation unit 36 calculates a position of the tip portion 13*c* of the arm 13 (referred to as an arm tip portion, see FIG. 1) based on the detection values of the boom angle sensor 26 and the arm angle sensor 28.

The controller 30 includes an arm-dumping limiting unit 37 and an arm-crowding control unit 38. The arm-dumping limiting unit 37 limits stroke of the arm cylinder 20 in the dumping direction D1. The arm-crowding control unit 38 controls movement of the arm 13 in the crowding direction D2.

With reference to FIG. 1, the stroke limitation of the arm cylinder 20 in the dumping direction D1 by the arm-dumping limiting unit 37 will be described.

In FIG. 1, a virtual line P1 shows a state of the arm 13 (first state) in which the arm cylinder 20 is contracted to a stroke end YE in the dumping direction D1. A solid line P2 shows a state of the boom 12 swung upward to the uppermost position.

In order to determine a position to limit the stroke of the arm cylinder 20 in the dumping direction D1, a predetermined limit distance 39 from a swiveling shaft center S1 (machine body 2) of the arm tip portion 13*c* to be limited is firstly determined. In other words, the maximum radius of the arm tip portion 13*c* to be limited in terms of stability is determined. The position of the arm tip portion 13*c* when the arm tip portion 13*c* is in the limit distance 39 is rearward of a point 41 where a horizontal line 40 passing through the boom pivot shaft 16 intersects with a first locus T1 drawn, around the boom pivot shaft 16, by the arm tip portion 13*c* in the first state P1. More specifically, a position of the arm tip portion 13*c* in the limit distance 39 is in a range between the first locus T1 and a second locus T2 drawn, around the boom pivot shaft 16, by a tip portion 12*c* of the boom 12.

A stroke of the arm cylinder 20 when the arm tip portion 13*c* is in the limit distance 39 is represented by a sign "Y1". Moreover, when the arm cylinder 20 is at the stroke Y1 and a height of the arm tip portion 13*c* is at a height position of the boom pivot shaft 16 (the second state shown by a sign P3 in FIG. 1), a stroke of the boom cylinder 19 is represented by a sign "X1".

Then, when the stroke of the boom cylinder 19 is in a stroke range Xb between the stroke X1 and a stroke end XE in the raising direction, the arm-dumping limiting unit 37 (controller 30) limits the stroke of the arm cylinder 20 in the dumping direction D1, thereby preventing the arm 13 from swinging further in the dumping direction D1 from the position when the arm cylinder 20 is at the stroke Y1. In detail, when the lever 35*a* of the operation member 35 is continuously operated in one direction, the arm-dumping limiting unit 37 does not control the arm control valve 31 to contract the arm cylinder 20 until reaching the stroke end YE in the dumping direction D1, thereby limiting the minimum stroke of the contracted arm cylinder 20 to the stroke Y1. That is, the arm-dumping limiting unit 37 stops the contracting action of the arm cylinder 20 when the arm cylinder 20 contracts to the stroke Y1.

Next, referring to FIG. 2, the stroke limitation of the arm cylinder 20 in the dumping direction D1 by the arm-dumping limiting unit 37 will be described, the stroke limitation being performed in a case where the arm tip portion 13*c* is positioned downward of the horizontal line 40.

Figure 2:
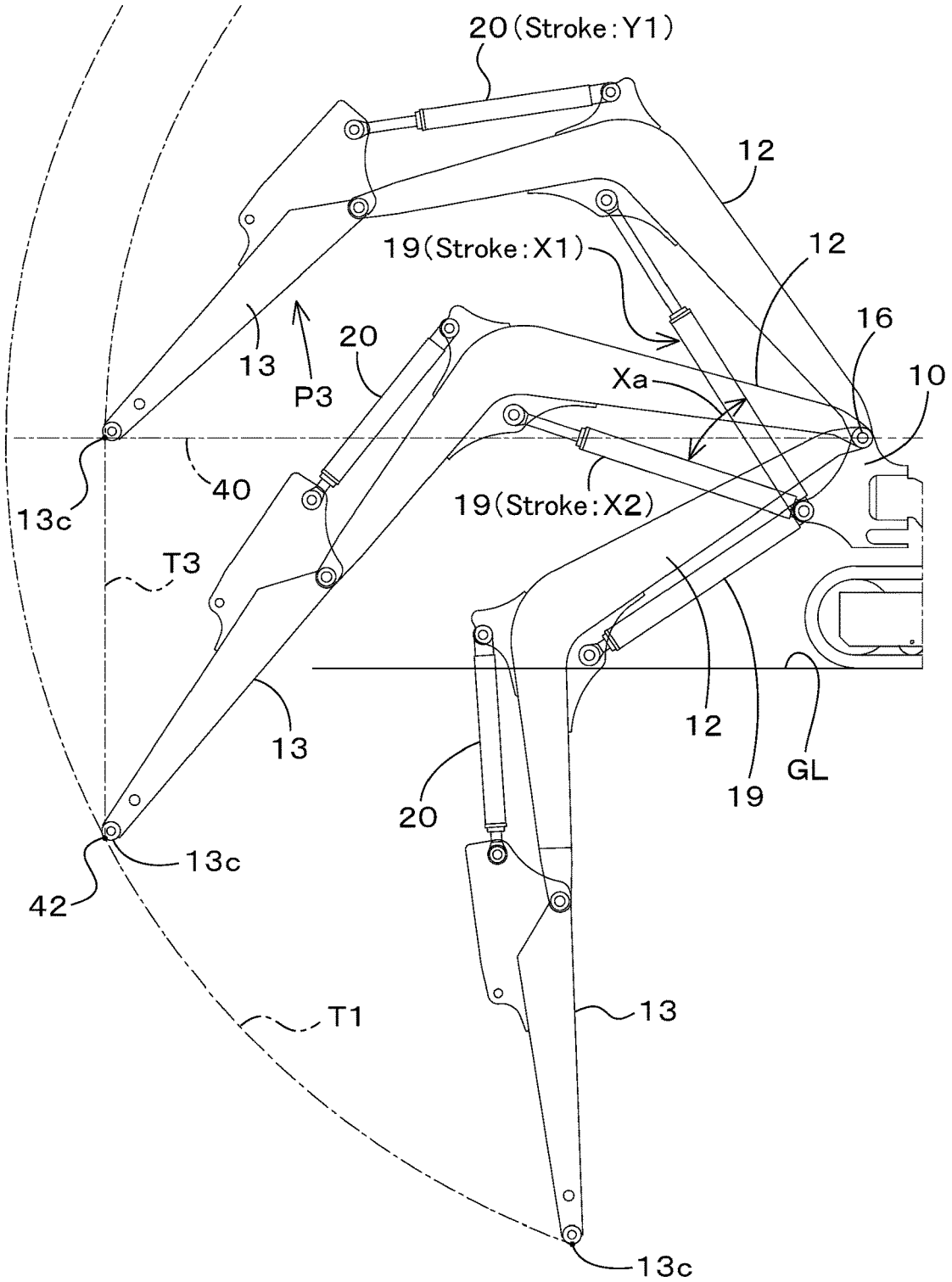
FIG. 2 is a side view showing movements of the boom and the arm.

In FIG. 2, the sign T3 indicates a vertical line extending downward from the arm tip portion 13*c* when the arm cylinder 20 is at the stroke Y1 and the boom cylinder 19 is at the stroke X1. A stroke of the boom cylinder 19 when the arm tip portion 13*c* is positioned at an intersection 42 of the vertical line T3 with the first locus T1 is represented by a sign "X2".

Then, when the boom cylinder 19 is actuated in a stroke range Xa between the strokes X1 and X2 to swing the boom 12, the arm-dumping limiting unit 37 (controller 30) limits the stroke of the arm cylinder 20 in the dumping direction D1 corresponding to each swing position of the boom 12 to prevent the arm tip portion 13*c* from moving across the vertical line T3. That is, when the boom cylinder 19 is in the stroke range Xa between the strokes X1 and X2, the arm-dumping limiting unit 37 restricts the stroke of the arm cylinder 20 in the dumping direction D1 even when the lever 35*a* of the operation member 35 is continuously operated in the one direction. In this manner, the arm-dumping limiting unit 37 prevents the arm tip portion 13*c* from moving across the vertical line T3 forward (an opposite direction to the machine body 2).

Next, referring to FIG. 2, an automatic control of movement of the arm 13 in the crowding direction D2 by the arm-crowding control unit 38 will be described.

In a case where the boom cylinder 19 is actuated in the stroke range Xa between the strokes X1 and X2 to swing the boom 12, the arm-crowding control unit 38 (controller 30) automatically controls the arm cylinder 20 such that the arm 13 is swung in the crowding direction D2 and the arm tip portion 13*c* moves on the vertical line T3, in swinging the arm cylinder 20 upward in a stroke of the arm cylinder 20 smaller than the stroke Y1. In addition, in the case where the boom cylinder 19 is actuated in the stroke range Xa between the strokes X1 and X2 to swing the boom 12, the arm cylinder 20 (arm control valve 31) is not automatically controlled in swinging the arm 13 downward.

In addition, in a case where the boom 12 is swung downward from the state where the boom cylinder 19 is at the stroke X2, the arm-dumping limiting unit 37 (controller 30) does not limit the stroke of the arm cylinder 20.

As shown in FIG. 5, the controller 30 includes a warning unit 43 and a cancellation unit 44. In addition, the controller 30 is connected to a notification unit 45 and a cancellation operation unit 46.

The warning unit 43 performs a warning when the stroke of the boom cylinder 19 is in a stroke range for positioning the boom 12 to be higher than a position corresponding to the stroke X2 and the arm cylinder 20 is at a stroke shorter than the stroke Y1 in the dumping direction D1 (in this embodiment, the stroke smaller than the stroke Y1). The warning unit 43 outputs a warning signal to the notification unit 45. The notification unit 45 is constituted of a lamp or a buzzer that emits a warning sound, and is activated by a warning signal from the warning unit 43.

The cancellation unit 44 cancels the limitation of the stroke of the arm cylinder 20 in the dumping direction D1 (arm dumping limitation) and the warning by the warning unit 43 through operation of the cancellation operation unit 46. The cancellation operation unit 46 may be a physically-operated hardware switch such as a pushbutton switch or a rotary switch, or a software switch that uses software to shift a switch to be on or off. The software switch is displayed, for example, on a display unit (screen) such as a meter panel or monitor disposed in front of the operator's seat 6. The cancellation unit 44 may be configured to cancel the arm dumping limitation and the warning by the warning unit 43 individually through operation of the cancellation operation unit 46.

In the above-described embodiment, when a stroke of the boom cylinder 19 is between the stroke X1 and the stroke end XE in the raising direction, the stroke of the arm cylinder 20 in the dumping direction D1 is limited such that the arm 13 is prevented from swinging further in the dumping direction D1 than the swinging when the arm cylinder 20 is at the stroke Y1. In addition, in a case where the boom cylinder 19 is actuated in the stroke range Xa between the strokes X1 and X2 to swing the boom 12, a stroke of the arm cylinder 20 in the dumping direction D1 is limited such that the tip portion 13*c* of the arm 13 corresponding to each swing position of the boom 12 is prevented from moving across the vertical line T3. Even when lengths of the boom 12 and arm 13 are set to reach a required bucket bottom height (height of the bottom of the bucket from a ground GL) and a required excavation depth, this configuration ensures a stability in a case where the boom 12 and the arm 13 are stretched forward. That is, while setting a large bucket bottom height and a large excavation depth, a stability in the case where the boom 12 and the arm 13 are stretched in the horizontal direction can be ensured (all of the bucket bottom height, excavation depth, and stability can be ensured).

In addition, even when the boom 12 and arm 13 are formed longer than conventional kinds of them and the excavation depth is set deeper than a conventional depth, the bucket bottom height and stability can be ensured, such that earth and sand can be moved upward efficiently, such as for dump loading, and good workability in a narrow space is improved.

In general, the automatic control of the arm and boom is often uncomfortable for an operator; however, in this embodiment, when a position of the boom 12 is higher than a position where a stroke of the boom cylinder 19 becomes the stroke X1, only an arm-dumping limiting function is performed to limit the arm cylinder 20 in the dumping direction D1, and there is no uncomfortableness of the automatic control.

In this embodiment, the arm 13 is automatically controlled in swinging in the crowding direction D2 only when the boom cylinder 19 is actuated in the stroke range between the strokes X1 and X2 to swing the boom 12 and the stroke of the arm cylinder 20 is smaller than the stroke Y1. This configuration minimizes the automatic control range, thereby reducing the operator's uncomfortableness.

In particular, in lifting the bucket from deep excavation, the operator usually operates the lifting of the bucket in simultaneous operation with the arm crowding, so there is almost no uncomfortableness for the operator.

In addition, when a narrow bucket, which provides more stability, is mounted as the working tool 14, the arm dumping limitation (or the arm dumping limitation and the warning by the warning unit 43) can be canceled to allow a work with a larger maximum excavation radius while ensuring the stability.

In this embodiment, the boom cylinder is configured to swing the boom 12 upward by extending the boom cylinder 19 and to swing the boom 12 downward by contracting the boom cylinder 19. However, the boom 12 may be configured to be swung upward by contracting the boom cylinder 19, and the boom 12 may be configured to be swung downward by extending the boom cylinder 19. In addition, the arm 13 is configured to be swung in the crowding direction D2 by extending the arm cylinder 20, and the arm 13 is configured to be swung in the dumping direction D1 by contracting the arm cylinder 20. However, the arm 13 may be configured to be swung in the crowding direction D2 by contracting the arm cylinder 20, and the arm 13 may be configured to be swung in the dumping direction D1 by extending the arm cylinder 20.

In this embodiment, the boom cylinder 19 is disposed on a lower side of the boom 12; however, not limited to this, the boom cylinder 19 may be disposed on the upper side of the boom 12. In this case, the more the stroke of the boom cylinder 19 increases, the more the boom 12 swings downward.

The working machine 1 according to the embodiment, includes the machine body 2, the boom 12 pivotally supported by the machine body 2 via the boom pivot shaft 16 so as to be swingable upward and downward, the arm 13 pivotally supported by the boom 12 so as to be swingable in the dumping direction D1 away from the boom 12 and the crowding direction D2 toward the boom 12, the boom cylinder 19 to swing the boom 12, the arm cylinder 20 to swing the arm 13, and the controller 30 configured or programmed to control the arm cylinder 20. A stroke of the arm cylinder 20 caused when a distance of the tip portion 13*c* of the arm 13 from the machine body 2 is equal to the predetermined limit distance 39 is defined as the stroke Y1, a stroke of the boom cylinder 19 caused when the stroke of the arm cylinder 20 is equal to the stroke Y1 and a height of the tip portion 13*c* of the arm 13 is equal to a height of the boom pivot shaft 16 is defined as the stroke X1, and when the stroke of the boom cylinder 19 is between the stroke X1 and the stroke end EX thereof in a direction to swing the boom 12 upward, the controller 30 is configured or programmed to restrict the stroke of the arm cylinder 20 to swing the arm 13 in the dumping direction D1 so as to prevent the arm 13 from swinging further in the dumping direction D1 from a position where the stroke of the arm cylinder 20 is equal to the stroke Y1.

According to this configuration, by limiting the stroke of the arm cylinder 20 in the dumping direction D1 when a distance of the tip portion 13*c* of the arm 13 from the machine body 2 is in the predetermined limit distance 39, the stability can be ensured even when the boom 12 and arm 13 are stretched in the horizontal direction. This allows the lengths of the boom 12 and arm 13 to be set to reach a required bucket bottom height and a required excavation depth while ensuring the stability when the boom 12 and arm 13 are stretched in the horizontal direction. That is, the stability when the boom 12 and arm 13 are stretched in the horizontal direction can be ensured while the bucket height and the excavation depth are set to be large. In addition, since only the stroke of the arm cylinder 20 is limited in the dumping direction D1, this configuration can prevent an operator from feeling uncomfortable with the operation.

In addition, the tip portion 13*c* of the arm 13, when the distance thereof from the machine body 2 is equal to the limit distance 39, is located between the first locus T1 of the tip portion 13*c* of the arm 13 in swinging centered on the boom pivot shaft 16 and the second locus T2 of the tip portion 12*c* of the boom 12 in swinging centered on the boom pivot shaft 16.

In addition, when the tip portion 13*c* of the arm 13 is located at the intersection 42 between the first locus T1 and the vertical line T3 extended downward from the tip portion 13*c* of the arm 13 and when the stroke of the arm cylinder 20 is equal to the stroke Y1 and the stroke of the boom cylinder 19 is equal to the stroke X1, the stroke of the boom cylinder 19 is defined as the stroke X2, and when the boom 12 is swung within the swing range defined by the boom cylinder 19 activating with variation of the stroke in the stroke range Xa between the stroke X1 and the stroke X2, the controller 30 restricts the stroke of the arm cylinder 20 to swing the arm 13 in the dumping direction D1 relative to the boom 12 at any position in the swing range so as to prevent the tip portion 13*c* of the arm 13 from moving across the vertical line T3.

According to this configuration, the stability of the working machine 1 can be ensured while setting a large excavation depth.

In addition, when the boom cylinder 19 is activated with variation of the stroke in the stroke range Xa between the stroke X1 and the stroke X2 and the stroke of the arm cylinder 20 is less than the stroke Y1, the controller 30 is configured or programmed to automatically control the arm cylinder 20 so as to swing the arm 13 in the crowding direction D2 to move the tip portion 13*c* of the arm 13 on the vertical line T3.

According to this configuration, in a case where the boom cylinder 19 is actuated in the stroke range Xa between the strokes X1 and X2, the operator does not need to operate the arm 13 in the crowding direction D2 to ensure the stability, thereby simplifying the operation.

In addition, when the boom 12 is swung from the position where the stroke of the boom cylinder 12 is equal to the stroke X2, the controller 30 does not restrict the stroke of the arm cylinder 20.

According to this configuration, a deep excavation work can be performed as conventionally.

In addition, the controller 30 includes the warning unit 43 configured or programmed to give a warning when the stroke of the boom cylinder 19 is in a stroke range such as to locate the boom 12 above the position of the boom 12 defined by the stroke X2 of the boom cylinder 19 and the stroke of the arm cylinder 20 is in a stroke range such as to locate the arm 13 in the dumping direction D1 from the position defined by the stroke Y1 of the arm cylinder 20.

According to this configuration, the operator can be warned that the arm cylinder 20 is at a stroke shorter than the stroke Y1 in the dumping direction D1.

In addition, the controller 30 includes the cancellation unit 44 configured or programmed to cancel restriction of a stroke of the arm cylinder 20 in the dumping direction D1.

According to this configuration, the maximum excavation radius can be increased by canceling the arm dumping limitation, for example, when a narrow bucket advantageous to stability is attached.

In addition, the working machine 1 further includes the swing bracket 10 provided on the front portion of the machine body 2 rotatably around the vertical axis S2, the boom angle sensor 26 configured to detect a swing angle of the boom 12 relative to the machine body 2, and the arm angle sensor 28 configured to detect a swing angle of the arm 13 relative to the boom 12. The boom 12 is pivotally supported by the swing bracket 10 via the boom pivot shaft 16, and the controller 30 includes the calculation unit 36 configured or programmed to calculate a position of the tip portion 13*c* of the arm 13 based on detection values detected by the boom angle sensor 26 and the arm angle sensor 28.

In addition, the controller 30 includes the cancellation unit 44 configured or programmed to cancel the warning given by the warning unit 43.

In the case of the swing-type working machine 1, since the swing bracket 10 is disposed on a front portion of the machine body, the stability of the machine body is likely to be reduced particularly when the boom 12 and the arm 13 are stretched forward horizontally. However, in this embodiment, by limiting the stroke of the arm cylinder 20 in the dumping direction D1 when the boom 12 and the arm 13 are stretched in the horizontal direction, the stability can be ensured even when the boom 12 and arm 13 are formed long in the swing-type working machine 1.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working machine, comprising:

a machine body;

a boom pivotally supported by the machine body via a boom pivot shaft so as to be swingable upward and downward;

an arm pivotally supported by the boom so as to be swingable in a dumping direction away from the boom and a crowding direction toward the boom;

a boom cylinder to swing the boom;

an arm cylinder to swing the arm; and a controller configured or programmed to control the arm cylinder, wherein a stroke of the arm cylinder caused when a distance of a tip of the arm from the machine body is equal to a predetermined limit distance is defined as a stroke Y1, a stroke of the boom cylinder caused when the stroke of the arm cylinder is equal to the stroke Y1 and a height of the tip of the arm is equal to a height of the boom pivot shaft is defined as a stroke X1, and when the stroke of the boom cylinder is between the stroke X1 and a stroke end thereof in a direction to swing the boom upward, the controller is configured or programmed to restrict the stroke of the arm cylinder to swing the arm in the dumping direction so as to prevent the arm from swinging further in the dumping direction from a position where the stroke of the arm cylinder is equal to the stroke Y1.

2. The working machine according to claim 1, wherein the tip of the arm, when the distance thereof from the machine body is equal to the limit distance, is located between a first locus of the tip of the arm in swinging centered on the boom pivot shaft and a second locus of a tip of the boom in swinging centered on the boom pivot shaft.

3. The working machine according to claim 2, wherein when the tip of the arm is located at an intersection between the first locus and a vertical line extended downward from the tip of the arm and when the stroke of the arm cylinder is equal to the stroke Y1 and the stroke of the boom cylinder is equal to the stroke X1, the stroke of the boom cylinder is defined as a stroke X2, and when the boom is swung within a swing range defined by the boom cylinder activating with variation of the stroke in a stroke range between the stroke X1 and the stroke X2, the controller restricts the stroke of the arm cylinder to swing the arm in the dumping direction relative to the boom at any position in the swing range so as to prevent the tip of the arm from moving across the vertical line.

4. The working machine according to claim 3, wherein when the boom cylinder is activated with variation of the stroke in the stroke range between the stroke X1 and the stroke X2 and the stroke of the arm cylinder is less than the stroke Y1, the controller is configured or programmed to automatically control the arm cylinder so as to swing the arm in the crowding direction to move the tip of the arm on the vertical line.

5. The working machine according to claim 3, wherein when the boom is swung from the position where the stroke of the boom cylinder is equal to the stroke X2, the controller does not restrict the stroke of the arm cylinder.

6. The working machine according to claim 1, wherein the controller includes a warning unit configured or programmed to give a warning when the stroke of the boom cylinder is in a stroke range such as to locate the boom above the position of the boom defined by the stroke X2 of the boom cylinder and the stroke of the arm cylinder is in a stroke range such as to locate the arm in the dumping direction from the position defined by the stroke Y1 of the arm cylinder.

7. The working machine according to claim 1, wherein the controller includes a cancellation unit configured or programmed to cancel restriction of a stroke of the arm cylinder in the dumping direction.

8. The working machine according to claim 1, further comprising:

a swing bracket provided on the front portion of the machine body rotatably around a vertical axis;

a boom angle sensor configured to detect a swing angle of the boom relative to the machine body; and an arm angle sensor configured to detect a swing angle of the arm relative to the boom, wherein the boom is pivotally supported by the swing bracket via the boom pivot shaft, and the controller includes a calculation unit configured or programmed to calculate a position of the tip of the arm based on detection values detected by the boom angle sensor and the arm angle sensor.

9. The working machine according to claim 6, further comprising:

a cancellation unit configured or programmed to cancel the warning given by the warning unit.

* * * * *